US005988656A

United States Patent [19]

Krah

[11] Patent Number: 5,988,656

[45] Date of Patent: Nov. 23, 1999

[54] QUICK RELEASE SKATE AXLE

[75] Inventor: Drew A. Krah, Vashon, Wash.

[73] Assignee: K-2 Corporation, Vashon, Wash.

[21] Appl. No.: 09/039,589

[22] Filed: Mar. 16, 1998

[51] Int. Cl.[6] ..... A63C 1/00

[52] U.S. Cl. ..... 280/11.27; 280/11.19; 280/11.22; 301/5.3

[58] Field of Search ..... 280/11.27, 11.19, 280/11.26, 11.23, 11.22, 7.12, 7.13; 301/5.3, 5.7

[56] References Cited

U.S. PATENT DOCUMENTS

| | | | |
|---|---|---|---|
| 298,110 | 5/1884 | Morse . | |
| 4,392,690 | 7/1983 | Anderson . | |
| 4,477,121 | 10/1984 | Atkins . | |
| 4,679,862 | 7/1987 | Luo . | |
| 5,190,301 | 3/1993 | Malewicz . | |
| 5,271,633 | 12/1993 | Hill, Jr. . | |
| 5,441,286 | 8/1995 | Pozzobon . | |
| 5,601,299 | 2/1997 | Yun et al. . | |
| 5,601,342 | 2/1997 | Perner . | |
| 5,630,652 | 5/1997 | Cech . | |
| 5,882,087 | 3/1999 | Post | 301/5.3 |
| 5,884,923 | 3/1999 | Pratt | 280/11.22 |

FOREIGN PATENT DOCUMENTS 0 876 835 11/1998 European Pat. Off. .

*Primary Examiner*—Kevin McKinley
*Attorney, Agent, or Firm*—Christensen O'Connor Johnson and Kindness PL

[57] ABSTRACT

A skate (10) including a plurality of quick release axle assemblies (26) for securing in-line skate wheels (44) to a skate boot (16). The skate includes a frame (12) having right and left side walls (18) and (20) that extend downwardly from a boot mounting platform (14), and having substantially aligned apertures 22 for receiving the quick release axle assemblies, which in turn secure the skate wheels. Each axle assembly contains a single spring-loaded plunger member (28), an axle housing (30) for receiving the plunger member, and at least one detent ball (32) which is held in a detent aperture (34) of the axle housing. When the axle is in the closed position for use, the detent ball projects from the aperture of the axle housing. The detent extends beyond the axle outer surface (38) and locates into a detent ball receiving groove (48) defined in the detent spacer (46) of the wheel to secure the axle. Selective release of the axle from the wheel is enabled by depressing the plunger member, which allows the detent ball to load inwardly into a detent ball receiving groove (40) in the plunger member.

46 Claims, 6 Drawing Sheets

10
16
14
14
24
22
18
21
22
22
20
22
26
44
22
22
26
44
44
26
12
26
44

QUICK RELEASE SKATE AXLE

FIELD OF THE INVENTION

The present invention relates to an improved quick-release in-line skate axle for securing skate wheels to a frame assembly, and more particularly to a self contained, spring-loaded axle assembly with an internal retractable detent.

BACKGROUND OF THE INVENTION

In-line roller skates include multiple wheels all rotating in a common plane and secured to a frame beneath each foot of the skater. The construction provides a skater with much of the same feeling experienced on an ice skate, while the in-line skate may be used on a much wider variety of terrain.

Typical in-line skates include four or five wheels of the same size having parallel axes of rotation generally within the same horizontal plane, perpendicular to the longitudinal axis of the frame. All of the wheels are carried and rotatably supported by the frame. The frame itself is then attached to the base of a shoe or boot.

Rapid wear of the wheels and associated bearings during use requires their frequent rotation and/or replacement. Traditionally, skate axles have been secured by screws or other similar components which require some type of wrench for removal. Thus, not only are specific tools required which may not be readily available, this type of removal and replacement process is also unnecessarily time consuming. Further, with this type of device, the various axle components, particularly the attachment components like nuts or screws, are not secured against misplacement, and may be easily lost.

Various attempts have been made to overcome these drawbacks by implementing devices that were designed to allow the quick disengagement and reengagement of the wheels without requiring the owner to use particular tools. These arrangements however, have not been met with wide acceptance. This is likely because these devices still required multiple components to secure the axle assembly and/or the devices had additional associated drawbacks. One common drawback of these conventional arrangements is that the axle locking components are located outside of the frame, extending substantially outward from the frame side wall. This makes these types of devices potentially susceptible to damage or unintentional release from the axle due to aggressive skating activities which cause substantial contact with the frame side walls.

Thus, conventional axle assemblies and recent alternative arrangements have proved unsuccessful in producing a satisfactory quick release axle. There still exists a need for an in-line roller skate with quickly removable wheels and self-contained, quick-release axles that can be easily removed without the assistance of specialized tooling.

SUMMARY OF THE INVENTION

The present invention discloses a quick-release frame and axle assembly for securing in-line skate wheels to a skate boot. The frame itself is composed of at least one mounting platform to which the skate boots are secured. It further contains right and left side walls that extend downwardly from the mounting platform(s). The lower region of these side walls include substantially aligned apertures for receiving the axles, which in turn secure the wheels.

The axle assembly portion of a preferred embodiment of the present invention includes a plurality of self-contained, spring-loaded axles that are insertable into corresponding detent spacers in the wheels. Each spring-loaded axle contains a single spring-loaded plunger member, an axle housing defining a chamber for receiving the plunger member, and at least one detent ball which is held in a bore formed transversely through the housing.

The self-contained spring in the axle chamber biases the plunger member to an extended position, keeping the axle in a normally closed configuration. When the axle is in the normally closed configuration, the detent ball is positioned by the extended plunger member to protrude from an aperture defined in the detent bore of the axle housing. In this position the detent ball extends beyond the outer surface of the housing and locates into a detent ball receiving groove in the detent spacer of the wheel unit. This selectively secures the axle to the wheel unit within the frame.

In order to selectively release the axle assembly from its detent spacer in the wheel, the plunger member is depressed inwardly, compressing the self-contained spring. This enables the axle to enter its open configuration, and allows the detent ball to drop inwardly into a detent ball receiving groove in the plunger member. Thus, the axle is no longer secured by the detent ball receiving groove in the detent spacer of the wheel, and can slide out of the frame assembly in either direction.

In an alternate preferred embodiment of the present invention, the spring loaded axles include an axle housing having an enlarged head on one end. This enlarged head will not slide through the axle-receiving apertures in the frame side walls, thus making the axle assembly uni-directionally releasable from the frame. In this alternate embodiment, the spring-loaded detent ball selectively engages with a detent ball receiving groove defined in one of the frame side walls. Thus the enlarged head of the axle housing bears against a first side wall, while the detent ball engages with the second side wall, structurally tying the two together while selectively mounting the wheel therebetween.

A quick release skate axle constructed in accordance with the present invention facilitates rapid removal and replacement of in-line skate wheels and their associated wheel detents. Further, this axle assembly does not require any special tools to release the axle, since any small cylindrical object, such as a key, the end of a shoe lace, or an allen wrench, is sufficient. This quick release skate axle is also a self contained unit, so there are no loose components such as lug nuts that can be lost during the disassembly and reassembly process. Finally, the above described quick release axle assemblies are mounted substantially within the envelope defined by the frame side walls, so there are no releasing components extending substantially outward from the frame side walls that could be unintentionally activated or damaged during aggressive skating activity.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
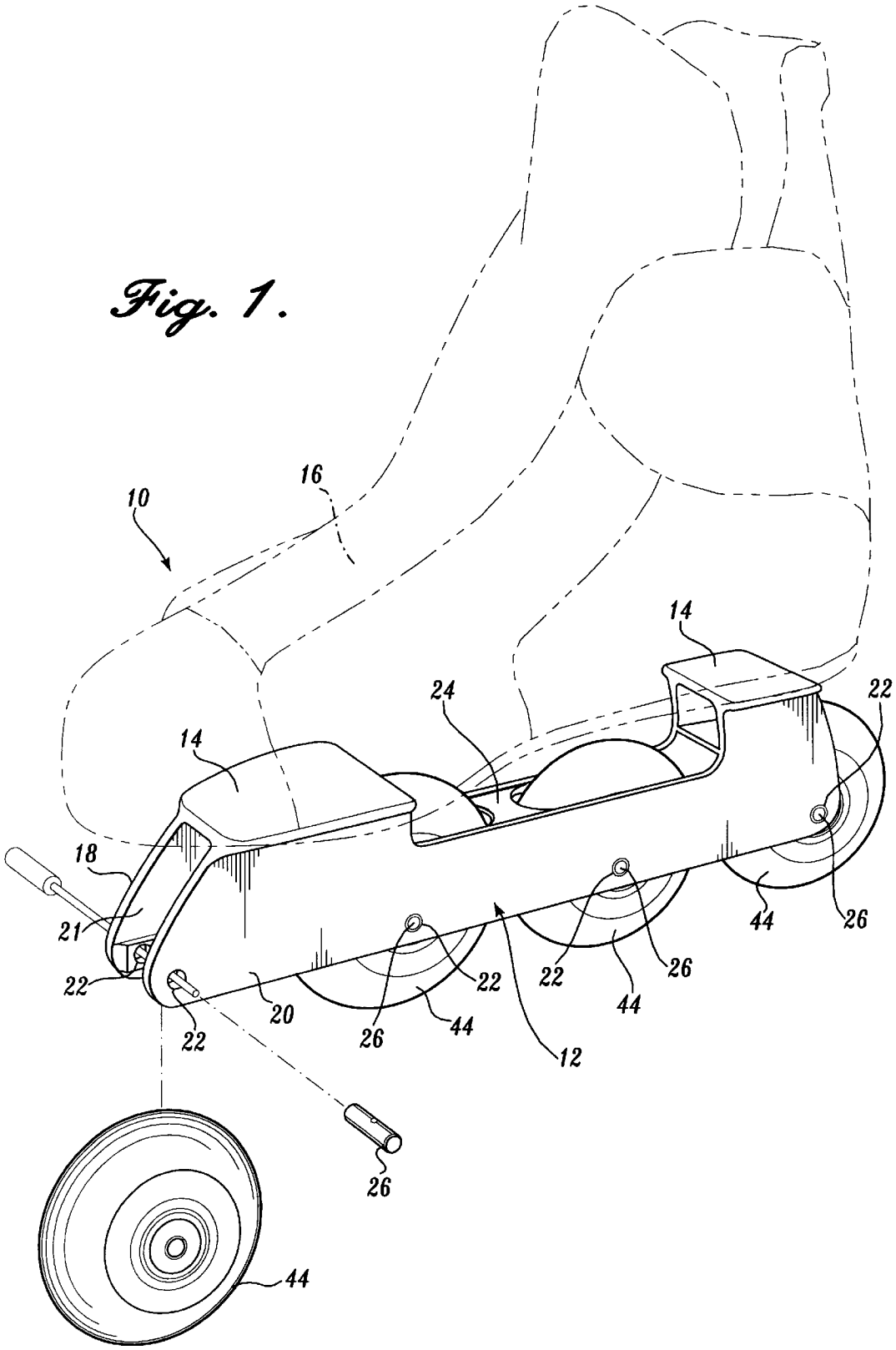
FIG. 1 illustrates a partially exploded elevated perspective view of a preferred embodiment of the present invention demonstrating a self-contained spring-loaded skate axle and associated skate wheel being released with a single depressing motion, with the upper portion of the skate being shown in phantom.

FIG. 1 illustrates a skate 10 including a plurality of a quick release skate axle assemblies constructed in accordance with a preferred embodiment of the present invention and designed to rotatably mount a plurality of in-line skate wheels 44 onto a skate boot 16. The wheel 44 may consist of a wheel and detent assembly or an assembly of a wheel, hub 47, detents and spacers. The assembly 10 includes an elongated frame 12 which runs parallel to the bottom of the skate boot 16. The frame 12 includes a mounting platform 14 to which the skate boot 16 is attached. The frame 12 further contains right and left side walls 18 and 20 that extend downward from the mounting platform 14 and create an elongated U-shaped channel 21 which encloses the upper portions of the in-line wheels 44. The lower region of the side walls 18 and 20 have a series of aligned apertures 22 by which the in-line wheels 44 can be secured. The apertures 22 in the lower side walls 18 and 20 are aligned in pairs on either side of the longitudinal axis of the frame 12 for proper wheel alignment. The frame section 12 also preferably contains transverse connecting braces 24 that strengthen and rigidify the frame side walls 18 and 20. In the preferred embodiment illustrated, the frame 12 is a one-piece plastic or metal extrusion or molding, though a multipart construction is also possible.

Figure 2:
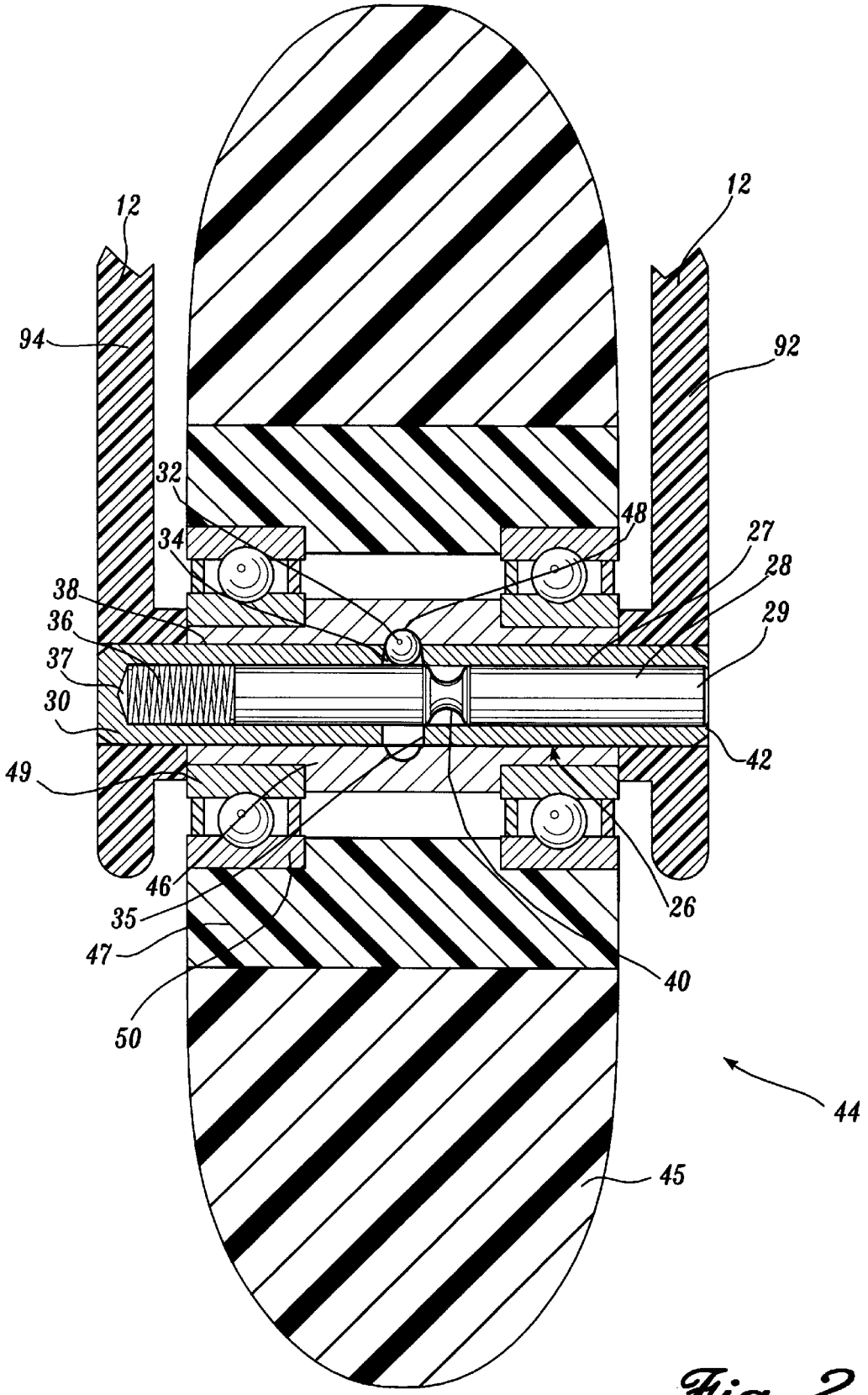
FIG. 2 illustrates a cross-sectional view of the preferred embodiment of FIG. 1 taken along a plane defined by the longitudinal axis of an axle assembly, showing a wheel mounted detent spacer member and spring-loaded axle, with the axle's plunger member extended in its normally closed position, thus securing the axle.

As can be seen in FIG. 1, the frame carries a plurality of self-contained spring-loaded axle assemblies 26 which locate in the apertures 22 of the frame side walls 18 and 20. The axle assemblies 26 are oriented generally orthogonally to the longitudinal axis of the frame 12. Referring now to FIG. 2, each axle assembly 26 contains an elongate plunger member 28, a compression spring 36, an elongate tubular axle housing 30 and a detent ball 32. The plunger member 28 is spring-loaded by the spring 36. This spring-loaded plunger member 28 is contained inside a longitudinal chamber 37 defined inside the axle housing 30. The chamber 37 extends from one open end of the housing 30 to nearly the opposite, closed end of the housing. The chamber 37, axle housings 30 and plunger member 28 are coaxially aligned. The plunger member 28 is shorter in length than the length of the chamber 37. The spring 36 is loaded inside the chamber 37, between the plunger member 28 and closed end of the chamber 37. The spring 36 biases the head 29 of the plunger member 28 to the open end 54 of the chamber 37. The open end 54 of the chamber 37 is defined by a swaged lip 42 such that the radius of the open end 54 is slightly less than the radius of the plunger head 29. This prevents the spring-loaded plunger 28 from being ejected from the axle chamber portion 30 by the partially compressed spring 36.

The axle housing 30 defines at least one detent aperture 34 for selective protrusion of a detent ball 32 contained within the axle housing 30. The aperture 34 is preferably formed by one end of a transverse bore 35 formed diametrically through a first side of the housing 30 and partially into the opposite side of the housing 30. The aperture 34 is defined at the outer extremity of a hemispherical end of the bore 35. The bore 35 receives the detent ball 32 such that the detent can protrude partially through but not escape from the aperture 34. The detent ball 32 is held in place on the inside of the axle housing 30 by the outer surface 27 of the plunger member 28. In this position, as shown in FIG. 2, just under half of the detent ball projects past the outer surface 38 of the axle housing 30.

The outer surface 27 of the spring-loaded plunger member 28 defines an annular detent ball receiving groove 40. When the plunger member 28 is loaded inside the axle housing 30, the plunger member is biased by the spring 36 such that the receiving groove 40 is nominally disposed longitudinally between the axle detent aperture 34 and the swaged lip 42 of the axle housing 30. In this locked or closed position, the detent ball 32 rides on a full diameter portion of the outer surface 27 of the plunger member 28, and is thus retained within the bore 35 with a portion of the detent ball 32 projecting from the aperture 34. However, if the plunger 28 is depressed within the axle housing 30, compressing the spring 36, the groove 40 aligns with the detent ball 32. This alignment allows the detent ball 32 to drop inwardly within the bore 35, to be partially received within the groove 40, to unlock or release open the axle assembly.

Figure 3:
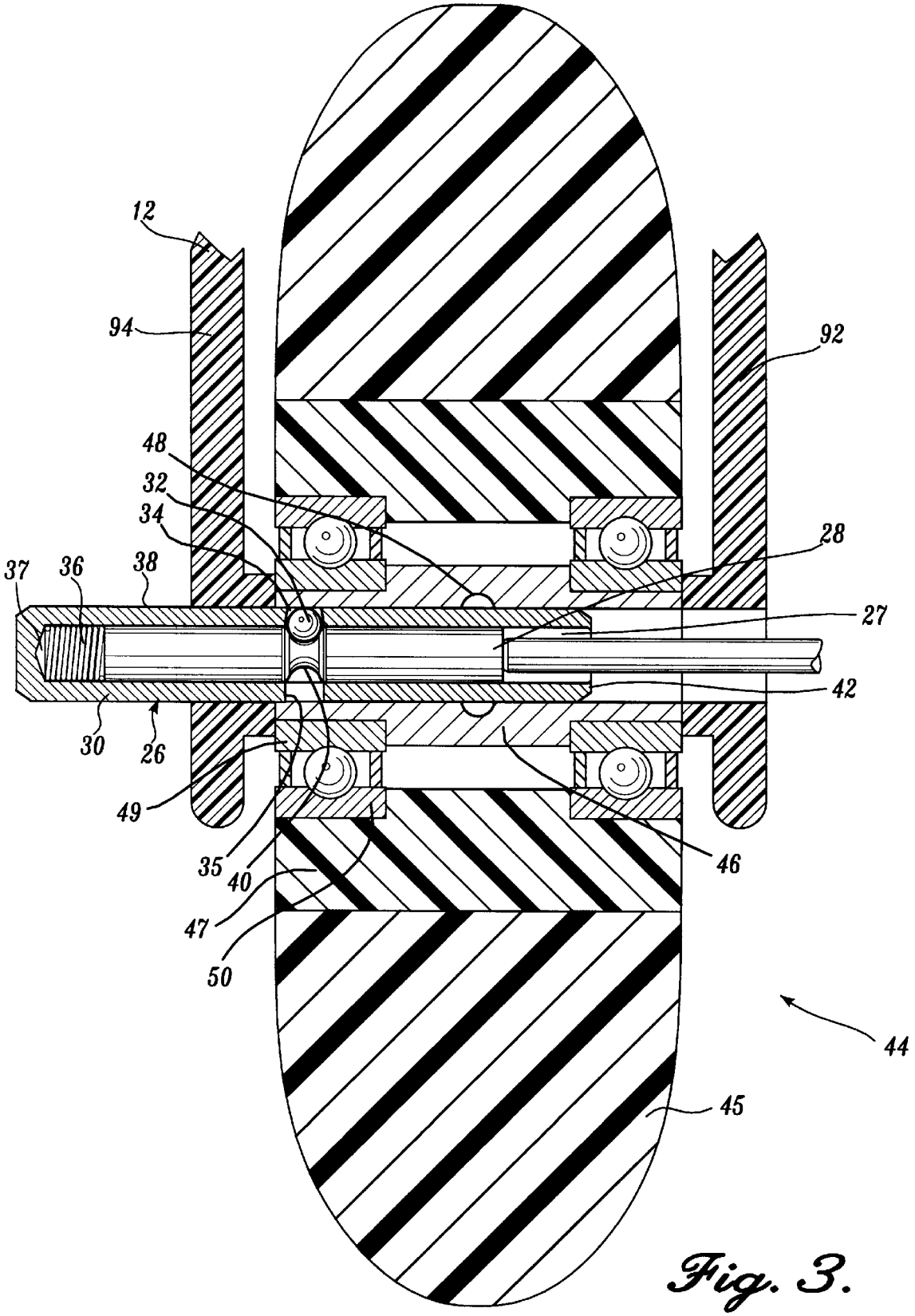
FIG. 3 illustrates a cross-sectional view as in FIG. 2, but with the axle's plunger member compressed into its open position, facilitating release of the axle.

The wheel 44 cooperates with the axle assembly 26 to make the quick release skate frame and axle assembly 10 functional. As shown in FIGS. 2 and 3, each wheel 44 contains a hub 47 and an annular detent spacer or retainer 46, preferably a bearing spacer. The inner detent surface of each detent spacer 46 defines an annular detent spacer receiving groove 48. This receiving grooving 48 is of a size sufficient to closely receive the portion of the detent ball 32 that protrudes past the aperture 34 of the housing 30 of the quick release axle 26 when the axle assembly 26 is locked.

Operation of the quick release axle assembly 26 will now be described with reference to FIGS. 2 and 3. As shown in FIG. 2, the spring 36 holds the plunger member 28 extended outward fully to the swaged lip 42 of the open end 54 of the axle chamber. This position of the quick release axle 26 will be referred to as the normally closed or locked position. When in the normally closed position, the detent ball 32 is held by the plunger outer surface 27 in the bore 35 so that it projects from the axle detent aperture 34. The plunger member's outer surface 27 thus forces the detent ball 32 to extend beyond the axle housing's outer surface 38. In this manner the detent ball 32, when properly aligned during installation, is urged into the detent receiving groove 48 of the detent spacer 46 in the wheel 44, and is locked into place.

This secures the detent spacer 46 and the bearing inner races 49 to the quick release axle assembly 26 and allows the outer portion of the wheel 44, including the bearing outer races 50 and the tire 45, to be rotatably secured to the axle assembly 26. Further, the axle and wheel are also operatively secured to the frame 12. All components of the axle assembly 26 fit within the envelope of the frame 12 in this locked position, and the axle assembly 26 is prevented from moving axially relative to the wheel 44. The skate is thus ready for use.

As shown in FIG. 3, the plunger member 28 can be selectively depressed inwardly with any small elongate object to remove the wheel 44, such as a key, boot lace tip or allen wrench. When the plunger member 28 is depressed inwardly, the spring 36 becomes more fully compressed. As the plunger member 28 is being depressed inwardly, a point is reached where the plunger member receiving groove 40 aligns with the axle detent aperture 34. At this point, the detent ball 32 loads inwardly, leaving the detent spacer receiving groove 48 and entering the plunger member receiving groove 40. Once this has occurred, the detent ball 32 no longer extends beyond the axle housing outer surface 38. This will be referred to as the open position.

When the spring-loaded axle assembly 26 enters its open position, this activates release of the axle from the detent spacer 46 in the wheel unit 44. The axle assembly 26 can then slide out of the apertures 22 in the left and right side walls 18 and 20 of the frame 12 and the wheel 44 can then be removed. It should be noted that the open position is unstable due to the spring 36 being compressed. Once the inward pressure against the plunger member 28 is removed, the spring 36 will return the plunger member 28 outward, and the axle assembly 26 will return to its normally closed position. After the in-line skate wheel 44 has been replaced, the axle assembly 26 can be put back into its open position and reloaded into the frame section 12 in wheel unit 44 using the above procedure. The insertion of the axle 26 into the wheel unit 44 in frame unit 12 can be achieved with a single motion, since the action to depress the plunger member 28 and put the axle 26 in its open position, can be continued to push the axle back into locking engagement in the detent spacer 46 of the wheel unit. This single motion loading and unloading ability of the axle 26 provides simplicity of operation and minimizes the time required for wheel replacement.

Referring again to FIGS. 2 and 3, the quick release axles 26 and wheel detent spacers 46 are both cylindrical and symmetrical in shape. The bore 35 and the groove 48 are preferably formed midway along the lengths of the axle housing 30 and detent spacer 46, respectively. This allows the axles to be loaded and unloaded in either direction once the plunger member 28 has been depressed and the axle 26 is in its open position. This provides for flexibility with respect to unloading and loading methods that is very convenient. It also allows for the axle 26 to be ejected from the wheel unit 44 in frame unit 12 with a single motion, since the action to depress the plunger member 28 and put the axle 26 in its open position, can be continued to push the axle completely through the wheel unit and frame.

The completely self-enclosed construction of the spring-loaded axles is also of substantial benefit. This self-enclosed construction is maintained both when the axle 26 is in its closed position and when it is in its open position. This design provides the advantage of preventing various types of dirt or debris from entering the axle 26 and corrupting the detent system.

The spring loaded quick release axle of the present invention engages and secures internally, substantially completely within the envelope defined by the outer surface of the frame side walls 18 and 20. This construction allows aggressive contact with the outside of the frame side walls, without risk of unintended release of a spring-loaded axle due to unintentional depression of an axle plunger member 28.

The construction of the present invention also creates a unique force distribution. Specifically, the quick release axle assembly 26 is secured in the axial direction only by the detent spacer receiving groove 48. Additionally, the frames dual side walls 18 and 20 secure the quick release axle 26 only in the vertical direction.

Figure 4:
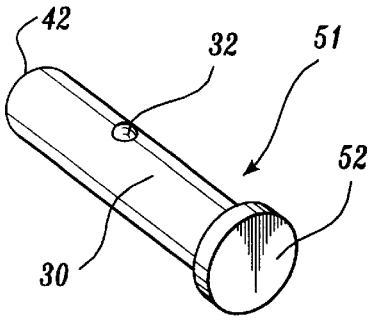
FIG. 4 illustrates an elevated perspective view of an alternate embodiment of the present invention, showing a modified self-contained spring-loaded skate axle with an enlarged head at one end of the axle, thus allowing only uni-directional release of the axle.
Figure 5:
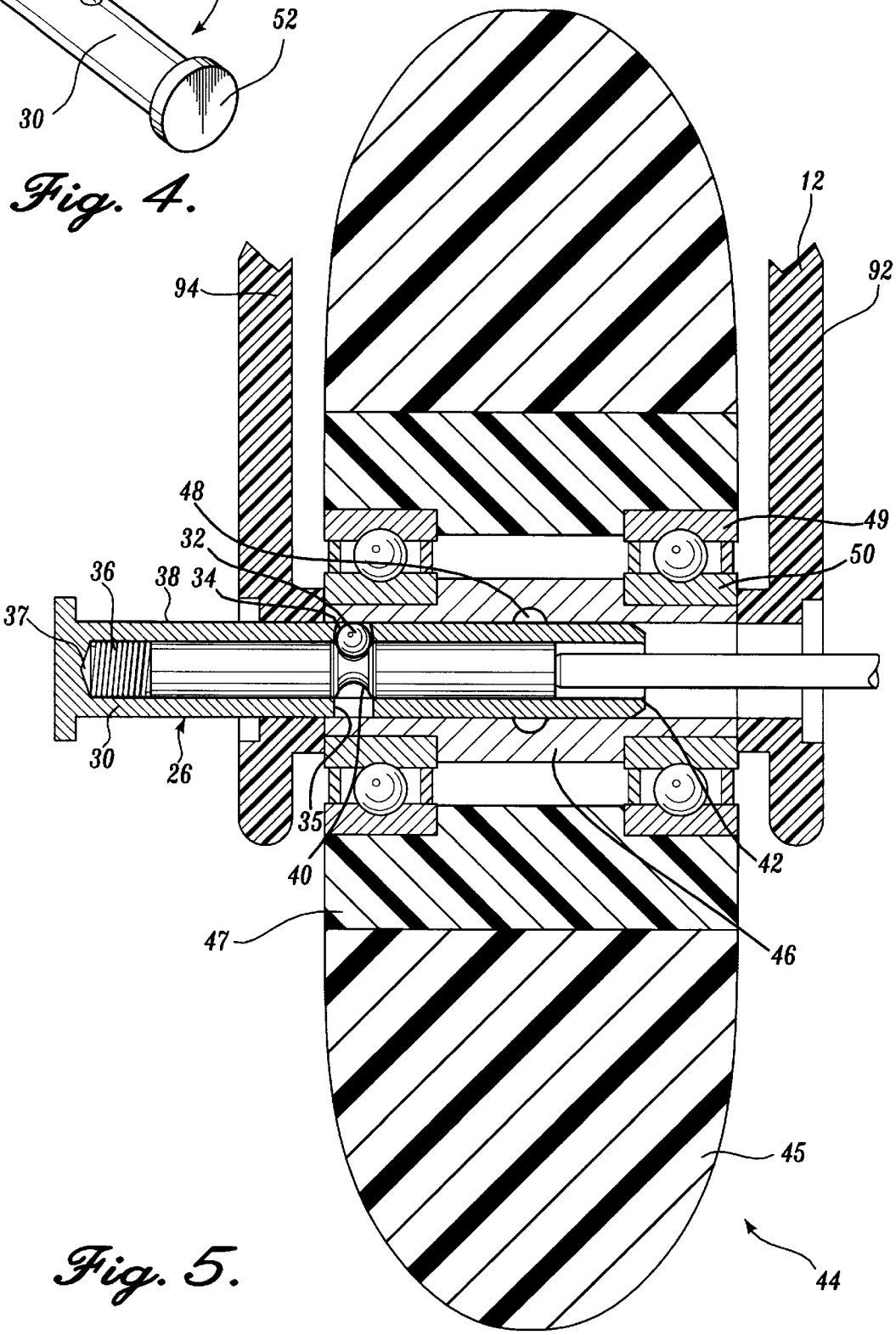
FIG. 5 illustrates a cross sectional view of the alternate embodiment of FIG. 4 showing a wheel mounted detent spacer member and the modified spring-loaded axle, with the axle's plunger member compressed into its open position, facilitating uni-directional release of the modified axle.

An alternate embodiment of the present invention, which is shown in FIGS. 4 and 5, incorporates a modified quick release axle assembly 51 with an enlarged axle head 52, that is preferably at the end opposite of the swaged end 42. This modified axle 51 is referred to as having a uni-directional head, in that it is asymmetrical, having an end defined by the head 52 of an enlarged radius that will not pass through the apertures 22 in the frame side walls 18 and 20. Thus, this alternate embodiment allows the modified axle assembly 51 to release only in one direction; towards the enlarged head 52. Since the enlarged radius head 52 is preferably opposite the swaged end 42 of the axle, from which the plunger member 28 is depressed, the modified axle assembly 51 can be released from the wheel with a single motion. However, to load the modified axle assembly 51, the plunger member 28 must be depressed in the direction opposite that of which the axle 51 is being loaded. This modified axle assembly 51 allows the frame 12 to carry some of the axial loading that is created during in-line skating activities. The quick release axle assembly 51 is otherwise identically constructed and operated in the same fashion as the quick release axle 26 previously described.

Figure 6:
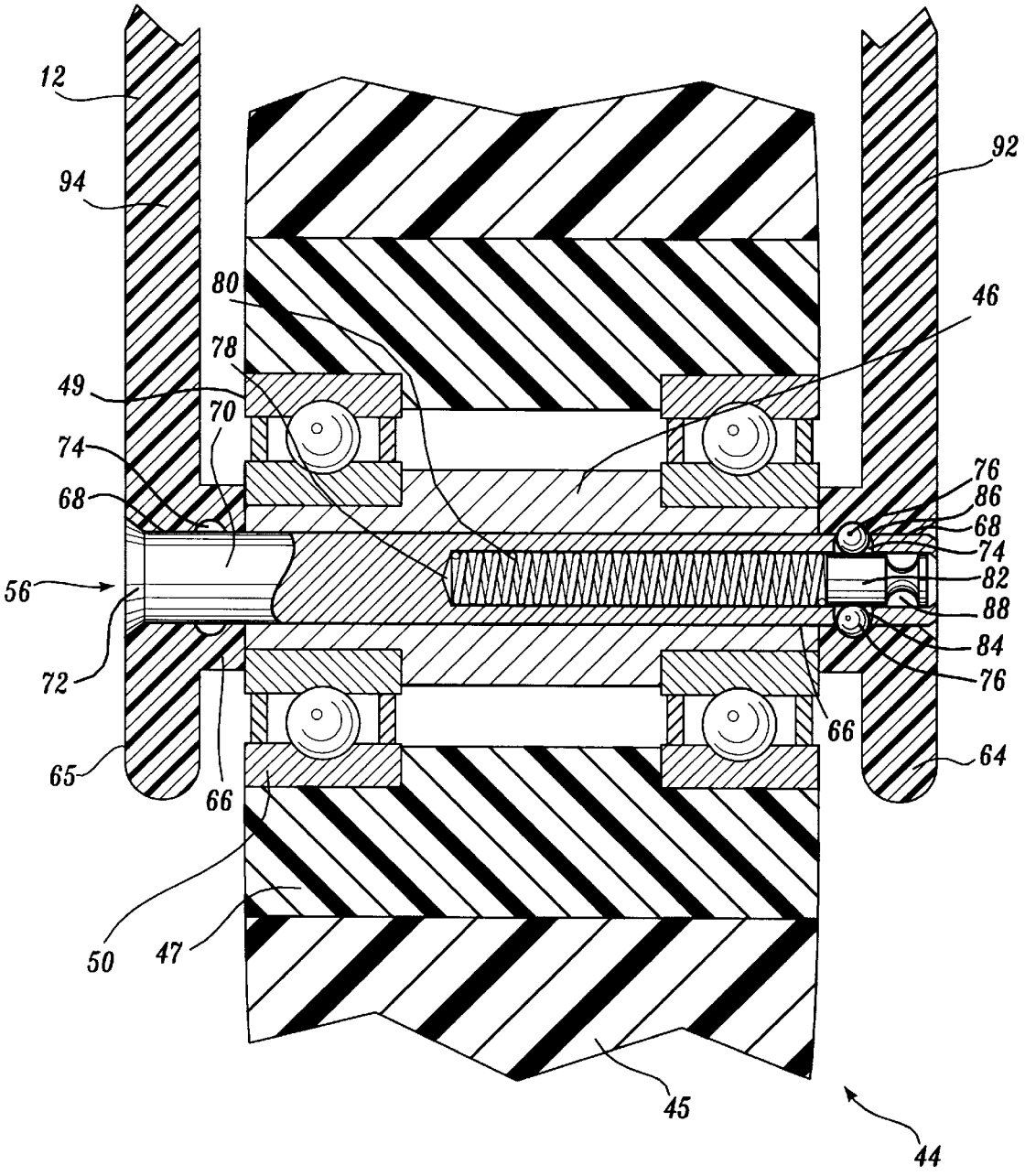
FIG. 6 illustrates a cross-sectional view of an additional alternate embodiment of the present invention, showing a frame wall mounted spring-loaded axle assembly, with the axle's plunger member extended in its normally closed position, thus securing the axle.

FIG. 6 illustrates yet another alternate embodiment of the present invention. This alternate embodiment incorporates a modified quick release axle assembly 56 and modified frame side walls 64 and 65.

The alternate embodiment of FIG. 6 is generally utilized in the same manner as the first preferred embodiment previously described in FIGS. 1–3, with the exception that the modified axle 56 is secured to the modified frame side walls 64 and 65, instead of securing to the detent spacer 46 of the wheel 44 as in the previous embodiment. This alternate embodiment has the advantage of efficiently transmitting forces directly from the axle to the frame with minimal resultant energy loss, and structurally ties the frame side walls together for greater frame strength. Because the modified quick release axle assembly 56 and associated frame side walls 64 and 65 are very similar to the previously described quick release axle assembly 26 and associated frame side walls 18 and 20, only those differences are described in detail below, with remaining features understood to be constructed and operate similarly.

Referring to FIG. 6, the frame side walls 64 and 65 each have a longitudinal boss 66 formed on the inner surface thereof. The longitudinal bosses 66 provide a thicker cross-sectional profile for the frame side walls 64 and 65 for greater strength, and for securement of the quick release axle assembly 56 transversely. The bosses 66 also act as frame spacers, and as such contact the bearing inner races 49 to provide an desirable load path through the frame side walls 64 and 65 and the wheels 44. The frame side walls 64 and 65 each define a plurality of pairs of passages 68 which extend through the bosses 66 for mounting of the axle assemblies 56. In the frame side walls 64 and 65 at least one, and preferably both ends of the passages 68 are each beveled on the outer ends thereof.

The quick release axle assembly 56 includes an axle housing 70 having an enlarged diameter head 72 on one end thereof. The enlarged diameter head 72 is received within the one of the beveled ends of the frame passages 68 of the side walls 64 and 65 when the axle assembly 56 is installed. Thus, provided that both ends of the passages 68 are beveled, the axle assembly 56 can be installed in either direction but can only be released in the direction opposite that in which it was inserted, as in the previously described axle assembly 51. The head 72 of the axle housing 70 bears against and transmits forces from the adjacent frame side wall.

Unlike the embodiment of FIG. 1, no special grooved detent spacer is required. Rather a groove, or simply a counter bore (not shown), is formed in the frame itself, preferably a groove or counter bore is formed in both frame side walls 64 and 65. A simple countersunk bore in the end of the passage 68 is sufficient for the detent balls 76 to outwardly load into locking engagement therewith, since the detent balls 76 must only secure the axle assembly 56 in one direction due to the enlarged diameter head 72 securing the axle assembly 56 in the other direction.

The opposite passages 68 defined in the other frame side wall each include an inner surface defining an annular detent retaining groove 74. Preferably, the passages 68 in both side walls include annular detent retaining grooves 74 such that in conjunction with the passages 68 in both side walls having beveled outer ends, the axle assembly 56 can be inserted in either direction. Each detent retaining groove 74 (or countersunk bore as described above) lockingly and selectively engages with one or more, and preferably at least two, detent balls 76 included in the associated axle assembly 56.

The axle housing 70 includes an internal chamber 78 that receives a compression spring 80 and a plunger member 82, similarly to the axle housing 30 previously described. However, in the embodiment of FIG. 6, the spring 80 is preferably longer, and the plunger member 82 preferably shorter, than that previously described. The axle housing 70 further includes a diametric bore 84 that defines first and second apertures 86 through which the detent ball 76 can selectively project, in the same fashion as that previously described. The bore 84 is internally chamfered or is swaged such that the detent ball 76 can project but not escape from the apertures 86. The apertures 86 are aligned with the detent receiving groove 74 of the axle housing 70 when the quick release axle assembly 56 is fully installed as shown in FIG. 6.

The plunger member 82 includes an outer surface that defines a full-diameter portion that nominally is positioned adjacent the detent balls 76 to cause them to project into locking engagement with the detent-receiving groove 74, as shown in FIG. 6. The plunger member 82 also defines an annular groove 88 around an outward portion thereof that can be selectively caused to align with the detent balls 76 by depressing the plunger member 82, compressing the spring 80. This enables the detent balls 76 to load into the groove 88, to unlock or open the axle assembly 56. Thus the axle assembly 56 operates similarly to that previously described, except that it not only secures the detent spacer 46 and the bearing inner races 49 of the wheel 44, allowing the outer portion of the wheel 44 (including the bearing outer races 50 and the tire 45) to be rotatably secured to the axle assembly 26, the axle 56 also ties the frame side walls 64 and 65 together.

Figure 7:
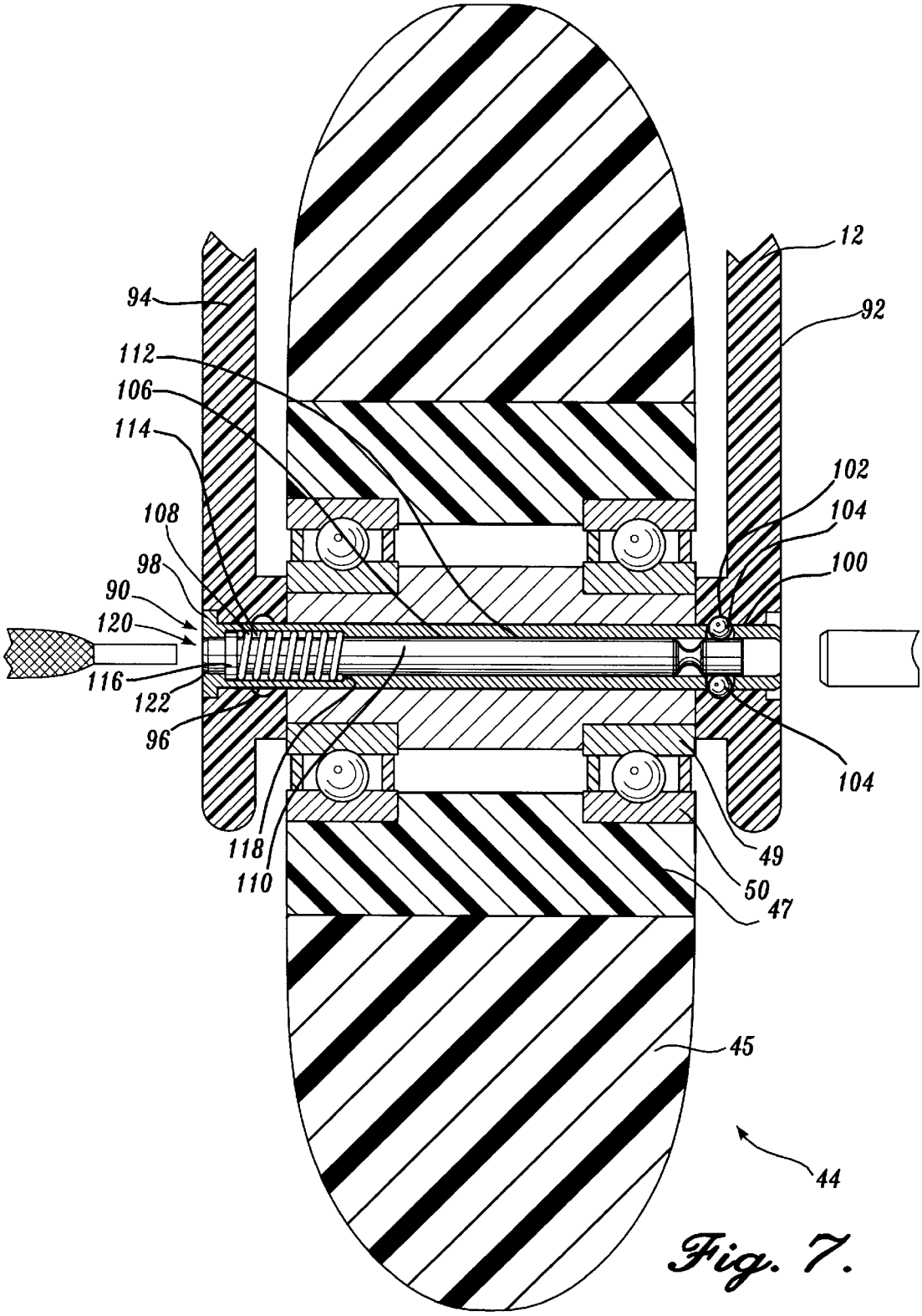
FIG. 7 illustrates a cross-sectional view of a further alternate embodiment of the present invention, including a spring loaded axle assembly with a plunger that is depressed oppositely of the direction of withdrawal of the axle assembly.

FIG. 7 illustrates still a further alternate embodiment of the present invention. This alternate embodiment is generally utilized in the same manner as the above described alternate embodiment shown in FIG. 6, in that a modified axle assembly 90 is secured to modified frame side walls 92 and 94, analogously to how the modified axle assembly 56 is secured to the modified frame side walls 64 and 65 of the previous embodiment. This additional alternate embodiment differs in that modified axle assembly 90 has an altered internal structure. Because the modified quick release axle assembly 90 and associated frame side walls 92 and 94 are still quite similar to the previously described quick release axle assembly 56 and associated frame side walls 64 and 65, only those differences are described in detail below, with remaining features understood to be constructed and operate similarly.

The quick release axle assembly 90 includes an axle housing 96 having an enlarged diameter head 98 at one end thereof. The enlarged diameter head 98 is received within the notched end of the frame passages 100 of the side wall 94 when the axle assembly 90 is installed. Preferably, both ends of the frame passages 100 are notched so that the axle assembly can be installed in either direction, in the same manner as the previously described axle assembly 56. At least each opposite passage 100 of the side wall 92, and preferably the passages 100 of both side walls 92 and 94, contain annular detent receiving grooves 102 to lockingly and selectively engage with one or more detent balls 104 included in the associated axle assembly 90.

The axle housing 96 includes a modified inner chamber 106 that receives a compression spring 108 and a plunger member 110. The axle housing 96 differs from the above described axle housings 30 and 70. Specifically, the modified inner chamber 106 contains two sections 112 and 114. The first section 112 extends for most of the length of the axle housing, while the second section 114 extends for a short distance adjacent to the head 98. The first section 112, defines a tubular wall of an internal diameter only slightly larger than outer diameter of the plunger member 110, similarly to previous embodiments of the present invention. The first section 112 however, transitions abruptly to the second section 114, which defines a tubular wall of a larger internal diameter, defining a shoulder therebetween.

The compression spring 108 is positioned around the outer surface of the plunger member 110 in the second section 114. The plunger member 110 itself includes a radial flange 116 that is only slightly smaller in diameter than the second section 114 of the modified inner chamber 106, formed on the plunger member 110 adjacent the enlarged diameter head 98 of the axle assembly 90. The spring 108 is partially compressed between the enlarged head of the plunger member 110 and the transition wall 118 between the first section 112 and second section 114 of the inner chamber 106, thus holding the axle assembly 90 in a normally closed position.

The modified inner chamber 106 has two open ends. The enlarged diameter head open end 120 is defined by a swaged lip 122 such that the radius of the open end 120 is slightly less than the radius of the enlarged plunger head. This prevents the spring-loaded plunger 110 from being ejected from the inner chamber 106 by the partially compressed spring 108. The plunger member 110 is longer than the previously described plunger members 28 and 82, extending almost the entire length of the axle housing 96. Depressing the plunger member 110 further compresses the spring 108 and moves the axle assembly 90 into its open position, as in previously described embodiments.

This alternate embodiment of the present invention can be installed with a single motion, by depressing the plunger member 110 of the modified axle assembly 90 during insertion of the axle assembly. As can be seen in FIG. 7 however, removal ofthe modified axle assembly 90 requires the plunger member 110 to be depressed in one direction to move the axle assembly 90 into its open position, while the opposite end of the axle assembly 90 is pushed in an opposing direction until the axle head 98 protrudes from the frame side wall 94. Once the axle head 98 is protruding from the side wall 94 the axle assembly 90 can be grabbed and withdrawn with the user's fingers.

It should be appreciated that for each of the above described axle assembly embodiments, alternate biasing devices could be utilized in place of compression springs, without departing from the scope of the present invention.

The present invention has been described in relation to a preferred embodiment and two alternate embodiments. One of ordinary skill, after reading the foregoing specifications, may be able to affect various other changes, alterations, and substitutions or equivalents without departing from the broad concepts disclosed. It is therefore intended that the scope of the Letters Patent granted hereon be limited only by the definitions contained in the appended claims and the equivalents thereof.

The embodiments of the invention in which an exclusive property or privilege is claimed are defined as follows:

1. A quick release frame and axle assembly for securing wheel assemblies to a skate boot, the wheel assemblies each defining a central aperture, comprising:

a frame adapted for securing the skate boot thereto and including a right and a left side wall extending downwardly from said skate boot for receiving the plurality of wheels therebetween, the right and left side walls each defining at least one transversely aligned aperture;

at least one biased axle assembly insertable into the aligned apertures of the frame side walls and through the central aperture of the wheel assembly to selectively and rotatably secure the wheel assembly between the frame side walls, the axle assembly comprising:

an axle housing defining an inner chamber and a tubular wall;

a biasing member received within the chamber of the axle housing;

a plunger received within the chamber of the axle housing to at least partially compress the biasing member; and a detent member received within the chamber of the axle housing to ride on an outer surface of the plunger and positioned thereby to selectively project from the housing into a retaining indentation defined by one of the frame side walls or wheel assembly, the plunger being selectively movable between a closed position, in which the detent member is urged by the plunger to project from the axle housing into the retaining indentation to mount the axle assembly and wheel assembly to the frame, and an open position, in which the detent retracts into the axle housing to release the axle assembly and wheel assembly.

2. The frame and axle assembly of claim 1, wherein the retaining indentation is defined by a wheel detent retainer.

3. The frame and axle assembly of claim 2, wherein the axle assembly is insertable in both directions from the left into the right frame side walls and from the right into the left frame side walls.

4. The frame and axle assembly of claim 2, wherein the axle assembly is insertable into the wheel detent retainer with same motion that moves the plunger into the open position.

5. The frame and axle assembly of claim 2, wherein the axle assembly is releasable from the wheel detent retainer with same motion that moves the plunger into the open position.

6. The frame and axle assembly of claim 2, wherein the axle assembly housing includes an enlarged head, so that the axle is releasable only in the direction opposite of the axle's insertion through the frame side walls.

7. The frame and axle assembly of claim 6, wherein the plunger is moved into the open position in a direction opposite a direction of release of the axle assembly.

8. The frame and axle assembly of claim 6, wherein the plunger is moved into the open position in the same direction as the direction of release of the axle assembly.

9. The frame and axle assembly of claim 1, wherein the retaining indentation is defined by at least one of the right and left side walls.

10. The frame and axle assembly of claim 9, wherein the axle housing includes an enlarged diameter head that engages with at least the other of the right and left side walls.

11. The frame and axle assembly of claim 1, wherein the chamber of the axle housing defines an open end and a closed end, and the biasing member is located within the chamber between the plunger and the closed end of the chamber, the plunger being configured to compress the biasing member within the chamber of the axle housing.

12. The frame and axle assembly of claim 1, wherein the plunger defines an outer surface having an enlarged diameter portion and a reduced diameter portion, and wherein the detent member rides on the outer surface of the plunger which moves the detent member between the locked and unlocked positions.

13. The frame and axle assembly of claim 12, wherein the biasing member is located around the outer surface of at least a portion of the plunger within the chamber of the axle housing, the plunger configured to compress the biasing member within the chamber of the axle housing.

14. The frame and axle assembly of claim 1, wherein the biasing axle assembly is substantially contained within an envelope defined by the right and left side walls.

15. The frame and axle assembly of claim 1, wherein the plunger is housed completely within the axle housing in the open and closed positions.

16. The frame and axle assembly of claim 1, wherein the first and second side walls of the frame secure the axle assembly only in a vertical direction.

17. The frame and axle assembly of claim 1, wherein the axle assembly is secured in the axial direction only by the retaining indentation and detent.

18. A skate including a boot, a frame including first and second downwardly projecting side walls, and a plurality of wheels secured between the first and second side walls, the wheels defining detent retainers, wherein at least one of the wheels is secured by a quick release axle assembly comprising:

an elongate axle housing insertable through aligned apertures defined in the first and second side walls;

a plunger movably retained within a chamber defined by the axle housing for selective movement between a locked position and an unlocked position;

a spring contained within the housing to bias the plunger to the locked position; and a detent member received within the axle housing and operated on by the plunger to move between a locked position, wherein the detent member is in locking engagement with one of the frame side walls or the wheel detent retainers when the plunger is in the locked position, thereby securing the axle assembly and wheel to the frame side walls, and an unlocked position, wherein the detent member is moved out of locking engagement with the one of the frame side walls or the wheel detent retainers when the plunger is in the unlocked position, thereby permitting release of the axle assembly and wheel.

19. The skate of claim 18, wherein the plunger defines an outer surface having an enlarged diameter portion and a reduced diameter portion, and wherein the detent member rides on the outer surface of the plunger which moves the detent member between the locked and unlocked positions.

20. The skate of claim 19, wherein the detent member comprises a detent ball that is received within a passage defined by a wall of the axle housing, the detent ball extending partially through an aperture defined in the axle housing wall in the locked position sufficiently to engage with one of the frame side walls or wheel detent retainers, and retracting at least partially into the passage of the axle housing wall in the unlocked position.

21. The skate of claim 18, wherein the detent member engages with an indentation defined in the detent retainer.

22. The skate of claim 21, wherein the indentation comprises an annular groove defined in an inner detent surface of the detent retainer.

23. The skate of claim 22, wherein the axle housing comprises a cylinder insertable from either direction through aligned apertures in the first and second side walls.

24. The skate of claim 18, wherein an indentation is defined in at least one side wall, so that the axle assembly is secured to the side wall when the plunger and detent member are in the locked position.

25. The skate of claim 24, wherein the axle assembly housing includes an enlarged diameter head that engages with at least the other side wall when the plunger and detent member are in the locked position.

26. The axle assembly of claim 18, wherein the axle assembly is substantially housed within an envelope defined by the first and second side walls.

27. A quick release frame and axle assembly for securing wheels to a skate boot, comprising:

a frame securable to the skate boot and including right and left downwardly depending side walls for receiving the plurality of wheels therebetween, the right and left side walls each defining at least one transversely aligned aperture; and at least one spring-loaded axle assembly insertable into the aligned apertures of the frame side walls and a spacer member defined by a wheel to selectively and rotatably secure the wheel between the frame side walls, the axle assembly comprising:

an axle housing defining an inner chamber and a tubular wall;

a spring received within the chamber of the axle housing;

a plunger received within the chamber of the axle housing to at least partially compress the spring; and a detent member received within the chamber of the axle housing to ride on an outer surface of the plunger and positioned thereby to selectively project from the housing into a retaining indentation defined by one of the frame side walls, the plunger being selectively movable between a closed position, in which the detent member is urged by the plunger to project from the axle assembly and into the retaining indentation of the side wall, and an open position, in which the detent member retracts at least partially into the axle housing to release the axle assembly from the frame side wall.

28. The frame and axle assembly of claim 27, wherein the axle assembly is insertable in both directions from the left into the right frame side walls and from the right into the left frame side walls.

29. The frame and axle assembly of claim 27, wherein the axle housing includes an enlarged diameter head so that the axle is releasable only in the direction opposite of the axle's insertion and the plunger is moved into the open position in a direction opposite of the direction of release of the plunger assembly.

30. A quick release frame and axle assembly for securing wheel assemblies to a skate boot, the wheel assemblies each defining a central aperture, comprising:

a frame adapted for securing the skate boot thereto and including a right and a left side wall extending downwardly from said skate boot for receiving the plurality of wheels therebetween, the right and left side walls each defining at least one transversely aligned aperture;

at least one biased retractable detent and axle assembly insertable into the aligned apertures of the frame side walls and through the central aperture of the wheel assembly to selectively and rotatably secure the wheel assembly between the frame side walls, the detent and axle assembly comprising:

an axle housing defining an inner chamber and tubular wall;

a biased retractable detent received within the chamber of the axle housing;

an axle member received within the chamber of the axle housing to at least partially deflect the biased retractable detent; and a detent member received within the chamber of the axle housing and positioned thereby to selectively project from the housing into a retaining indentation defined by at least one of the frame side walls or the wheel assembly, the axle member being selectively movable between a closed position, in which the detent member is urged by the axle member to project from the axle housing into the retaining indentation to mount the axle assembly and wheel assembly to the frame, and an open position, in which the detent retracts into the axle housing to release the axle assembly and wheel assembly.

31. The frame and axle assembly of claim 30, wherein the axle assembly is insertable in both directions from the left into the right frame side walls and from the right into the left frame side walls.

32. The frame and axle assembly of claim 30, wherein the axle housing includes an enlarged diameter head so that the axle is releasable only in the direction opposite of the axle's insertion.

33. An axle assembly for an in-line skate wheel securable to a skate frame having side walls containing transversely aligned apertures, the axle comprising:

a housing including an inner chamber defined by chamber walls, and having an axial opening and at least one side opening; the axle housing being insertable into the aligned apertures of the frame side walls and through the wheel to selectively and rotatably secure the wheel between the frame side walls;

a plunger member movably retained within said inner chamber for selective movement between a locked position and an unlocked position, said plunger member having at least one recess therein;

at least one detent member held partially within said side opening of said chamber walls, and selectively engageable with said plunger member recess;

a biasing member received within the inner chamber of the housing; and a detent retainer to be held within the wheel or one of the frame side walls, said detent retainer being positionable on the outside of said axle housing and including a detent recess to selectively receive said detent member to secure said housing in locking engagement with one of the frame side walls or the wheel, thereby securing the wheel to the frame.

34. The axle assembly of claim 33, wherein the detent member comprises a detent ball that is received within the side opening defiled by chamber walls of the axle housing, the detent ball extending partially through the side opening defined in the axle housing when the plunger is in the locked position sufficiently to engage with one of the detent retainers, thereby securing the axle housing and wheel to the frame side walls, and the detent ball retracting at least partially into the side opening of the axle housing when the plunger is in the unlocked position, thereby permitting release of the axle housing and wheel.

35. The axle assembly of claim 34, wherein the detent retainer is defined by a wheel.

36. The axle assembly of claim 35, wherein the axle housing is insertable in both directions from the first into the second frame side wall and from the second into the first frame side wall.

37. The axle assembly of claim 35, wherein the axle housing is insertable into the wheel detent retainer with same motion that moves the plunger member into the unlocked position.

38. The axle assembly of claim 35, wherein the axle assembly is releasable from the wheel detent retainer with same motion that moves the plunger member into the unlocked position.

39. The axle assembly of claim 35, wherein the axle housing includes an enlarged head, so that the axle is releasable only in the direction opposite of the axle's insertion through the frame side walls.

40. The axle assembly of claim 39, wherein the plunger member is moved into the unlocked position in a direction opposite a direction of release of the axle assembly.

41. The axle assembly of claim 39, wherein the plunger member is moved into the unlocked position in the same direction as the direction of release of the axle assembly.

42. The axle assembly of claim 34, wherein the detent retainer is defined by at least one of the frame side walls.

43. The axle assembly of claim 42, wherein the axle housing includes an enlarged diameter head that engages with at least the other of the frame side walls.

44. The axle assembly of claim 34, wherein the inner chamber of the axle housing defines an axial opening end and a closed end, and the biasing member is located within the inner chamber between the plunger member and the closed end, the plunger member being configured to compress the biasing member within the inner chamber of the axle housing.

45. The axle assembly of claim 34, wherein the plunger member defines an outer surface having an enlarged diameter portion and a reduced diameter portion, and wherein the detent member rides on the outer surface of the plunger member which moves the detent member between the locked and unlocked positions.

46. The axle assembly of claim 45, wherein the biasing member is located around the outer surface of at least a portion of the plunger member within the inner chamber of the axle housing, the plunger member configured to compress the biasing member within the inner chamber of the axle housing.

* * * * *